US005529147A

United States Patent [19]

Tsuji

[11] Patent Number: 5,529,147

[45] Date of Patent: Jun. 25, 1996

[54] APPARATUS FOR CONTROLLING ELEVATOR CARS BASED ON CAR DELAY

[75] Inventor: Shintaro Tsuji, Inazawa, Japan

[73] Assignee: Mitsubishi Denki Kabushiki Kaisha, Tokyo, Japan

[21] Appl. No.: 277,136

[22] Filed: Jul. 19, 1994

Related U.S. Application Data

[63] Continuation-in-part of Ser. No. 714,015, Jun. 12, 1991, abandoned.

[30] Foreign Application Priority Data

Jun. 19, 1990 [JP] Japan ..... 2-158814

[51] Int. Cl.[6] ..... B66B 1/22; B66B 1/08

[52] U.S. Cl. ..... 187/382; 187/391

[58] Field of Search ..... 187/380, 382, 187/391, 392, 385

[56] References Cited

U.S. PATENT DOCUMENTS

| | | | |
|---|---|---|---|
| 4,760,895 | 8/1988 | Yamaguchi . | |
| 4,802,557 | 2/1989 | Umeda et al. | 187/121 |
| 4,878,562 | 11/1989 | Schroder | 187/127 |
| 4,947,965 | 8/1990 | Kuzunuki . | |
| 4,990,838 | 5/1990 | Kawato . | |
| 4,991,694 | 2/1991 | Friedli | 187/127 |
| 5,022,498 | 6/1991 | Sasaki et al. | 187/127 |
| 5,040,215 | 8/1991 | Amano et al. | 381/43 |
| 5,046,019 | 9/1991 | Basehore | 395/3 |
| 5,073,867 | 12/1991 | Murphy et al. | 395/27 |
| 5,229,559 | 7/1993 | Siikonen et al. | 187/124 |
| 5,250,766 | 10/1993 | Hikita et al. | 187/133 |
| 5,331,121 | 7/1994 | Tsuji | 187/124 |
| 5,412,163 | 5/1995 | Tsuji | 187/382 |

FOREIGN PATENT DOCUMENTS

| | | | |
|---|---|---|---|
| 0275381 | 1/1990 | Japan | B66B 1/18 |
| 2-286581 | 11/1990 | Japan . | |
| 331171 | of 1991 | Japan . | |
| 2086081 | of 1981 | United Kingdom . | |
| 2222275 | of 1989 | United Kingdom . | |
| 2235312 | of 1990 | United Kingdom . | |
| 2237663 | of 1990 | United Kingdom . | |

OTHER PUBLICATIONS

"Collective Computation in Neuronlike Circuits"; Scientific American; vol. 257, pp. 104–108; Dec. 1987.

"Design of a Neural–Based A/D Converter Using Modified Hopfield Network"; IEEE Journal of Solid–State Circuits, vol. 24, no. 4, pp. 1129–1135; Aug. 1989.

"Designing Computers That Think the Way We Do":Technology Review May/Jun. 1987.

"Brain Wave Hits Japanese Computers"; New Scientist; Nov. 26, 1988.

*Primary Examiner*—Robert Nappi

*Attorney, Agent, or Firm*—Leydig, Voit & Mayer

[57] ABSTRACT

An elevator control apparatus determines an estimated car delay when the elevator car stops at or passes an elevator hall and controls an operation of the car using the obtained estimated car delay. The elevator control apparatus includes an input data conversion unit for converting traffic data, including position of the car, direction of movement, and car calls and hall calls, such that it can be used as input data of a neural net. An estimated car delay operation unit includes an input layer for taking in the input data, an output layer for outputting the estimated car delay, and an intermediate layer provided between said input and output layers in which a weighting factor is set. An output data conversion unit converts the estimated car delay output from the output layer such that it can be used for a predetermined control operation. The estimated car delay operation unit constituting a neural net.

19 Claims, 8 Drawing Sheets

APPARATUS FOR CONTROLLING ELEVATOR CARS BASED ON CAR DELAY

This application is a continuation-in-part of application Ser. No. 07/714,015, filed Jun. 12, 1991 now abandoned.

BACKGROUND OF THE INVENTION

1. Field of the Invention

This invention relates to an elevator control apparatus which is capable of estimating with a high degree of accuracy whether or not an elevator car will be delayed (the delay of the elvator car) in reaching each floor of a building and the amount of the delay.

2. Description of the Related Art

In a conventional elevator systems having a plurality of elevator cars, group control operation is generally conducted. An example of such a group control operation is the allocation method that matches elevator cars with calls. The allocation method is designed to improve the operation efficiency of and shorten the waiting time for a car by determining an evaluated value for each car immediately after a hall call is registered, by selecting the car which has the best evaluated value as the car to be allocated, and by making only that car respond to the hall call.

In the recent group controlled elevator apparatus, arrival of the allocated car is in general notified to the passengers who are waiting for the car by lighting the forecasting lamp of the allocated car before the car reaches the floor. This is called "forecasting". When this forecasting is made, the passengers who are waiting for the elevator car are given notice of the elevator car to be put into service first, and thus can wait for the arrival of the car in front of it.

However, an elevator car which has not been forecast may arrive faster than the forecast car in response to the car call (this is called "wrong forecasting"). Since such wrong forecastings confuse the passengers who are waiting at the hall, they are undesirable.

Various methods for preventing wrong forecasting have been proposed. For example, Japanese Patent Publication No. 47787/1987 discloses an elevator group-control apparatus which is designed to select, as a car to be allocated, a car which has the minimum general evaluated value when a hall call is registered. The general evaluated value is the sum of an evaluated waiting time value and an evaluated wrong forecasting value. The evaluated waiting time value is the sum of the squares of the estimated waiting times of all the hall calls when the hall call is virtually allocated to the individual elevator cars. The evaluated wrong forecasting value is obtained by weighting the sum of the wrong forecasting probabilities (an index indicating the possibility that the car which is not forecast arrives first) for all the hall calls when the hall call is virtually allocated to the individual cars.

In the above-described group control system, the wrong forecasting probability is obtained by the following equation:

Wrong forecasting probability=first arrival probability x car call generation probability The first arrival probability is an index which takes variations in the estimated arrival time of the car into consideration and which indicates the possibility that an elevator car other than the forecast (allocated) car will reach the hall where forecasting is made first (regardless of the stoppage of that car at that hall). The first arrival probability is calculated on the basis of overlapping of the probability distribution of the arrival times of the forecast and non-forecast elevator cars and the difference in the estimated arrival time (the first arrival time difference) between the forecast car and the non-forecast car. The car call generation probability is an index which indicates the possibility that the non-forecast car will have a car call on the hall where forecasting is made. When the non-forecast car already has a car call on the floor where forecasting is made, "1.0" is set as the car call generation probability. In other cases, the car call generation probability is set on the basis of the results of statistics conducted on the number of people who get on and off the car with the passengers who get on the car at the floors located between the current floor and the desired floor taken into consideration.

Japanese Patent Laid-Open No. 125580/1983 discloses an elevator group control method in which a difference in the estimated arrival time (car call first arrival time) between the allocated car and the non-allocated car which arrives in response to the car call is weighted by the car call first arrival time and the obtained value is used as one element of the evaluated hall call value.

Japanese Patent Laid-Open No. 36865/1983 discloses an elevator group control method in which the car call first arrival time is weighted by the distance (the number of floors) through which the car which generates car call first arrival must travel until it reaches the floor which generates the car call first arrival and the obtained value is used as one element of the evaluated hall call value.

Thus, allocation of the elevator car to the hall call is made on the basis of the estimated value of the car delay that is, the estimated car delay (which may be the wrong forecasting probability, the first arrival probability, the first arrival time difference, the car call first arrival time, or a value obtained by conducting a predetermined weighting on the car call first arrival time). Consequently, the waiting time for the hall call can be shortened and generation of wrong forecasting can be reduced.

Other elevator group control methods which have been proposed include one (Japanese Patent Publication No. 56708/1983) in which a car having the minimum wrong forecasting probability for a newly registered hall call is allocated to the hall call, one (Japanese Patent Publication No. 56708/1983) in which, when the wrong forecasting probability for a newly registered hall call exceeds a predetermined value, allocation is delayed until that probability becomes less than the predetermined value, and one (Japanese Patent Publication No. 46151/1987) in which a car having the minumum total sum of the wrong forecasting probabilities for the new hall call and already allocated hall calls is allocated to a hall call.

In the above-described conventional methods, an inaccurate estimated car delay makes the obtained evaluated value insignificant as the reference value with which a car to be allocated is selected, and thus increases generation of wrong forecasting. Thus, accuracy of the estimated car delay greatly affects the performance of the group control system.

Group control methods intended to prevent wrong forecasting by means other than the control of the hall call allocation have also been proposed. Such methods include one (Japanese Patent Laid-Open No. 12577/1988) in which, when a non-forecast car estimated to arrive faster than the forecast car is detected, an arrival accelerating instruction is output to the forecast car so as to decrease the time required for that car to stop and pass the floors before it arrives at the floor where forecasting is made; one (Japanese Patent Laid-Open No. 8180/1988) in which an arrival postponing instruction is output to the non-forecast car so as to increase the time required for that car to stop and pass the floors before it arrives at the floor where forecasting is made; and one (Japanese Patent Laid-Open No. 2850/1978) in which lighting of the forecasting lamp is postponed until the wrong forecasting probability fulfills a predetermined condition.

Other group control methods which use the estimated car delay in order to achieve the objects other than prevention of wrong forecasting have also been proposed. Such group control methods include one (Japanese Patent Laid-Open No. 153551/1977) in which, when there is the possibility that wrong forecasting occurs, the first arrival car is identified so as to prevent passenger confusion; and one (Japanese Patent Laid-Open No. 29057/1977) in which, when the car which is expected to arrive first at the floor comes within a predetermined distance from the floor, allocation and forecasting are changed to that car which arrives first. In these group control systems, accuracy of the estimated car delay greatly affects the performance of the group control operation.

To obtain an accurate car delay, the estimated arrival time, the car call generation probability, or the probability distribution of arrival time must be calculated with a high degree of accuracy. Conventionally, the estimated arrival time is basically calculated first by calculating the time required for the car to travel from the current position to the objective floor on the basis of the distance between the current position and the objective floor, then by calculating the time (stoppage time) during which the car stops at the floors before the car reaches the objective floor on the basis of the number of times the car stops, and finally by adding these two types of times, as is described in Japanese Patent Publication No. 20742/1979. To improve the accuracy with which the arrival time is estimated, the estimated value of the stoppage time is corrected in accordance with the state of the car at the current car positioned floor (Japanese Patent Publication No. 40074/1982), the estimated value of the stoppage time is corrected in accordance with the number of people who get on or off the car or the type of responding call (Japanese Patent Publication No. 40072/1982), the estimated value of the stoppage time is corrected on the basis of the estimation of the car call generation (Japanese Patent Publication No. 34111/1988), or the estimated value of the running time is corrected with the change in the running direction of the car on its way to the objective floor taken into consideration (Japanese Patent Publication No. 16293/1979).

Japanese Patent Laid-Open No. 275381/1989 discloses a group-control apparatus which selects the car to be allocated to the hall call on the basis of the results of the operation conducted using the neural net corresponding to the neurons of the human's brain. However, no consideration is given to the improvement of the accuracy with which the estimated car delay is operated.

In the conventional elevator control apparatus, various elements, including the state of the floor where the car is to stop, the state of the car, the type of responding call, the estimated number of passengers who get on or get off at the floors where the car is to stop, estimation of generation of car call, estimation of allocation of the car to a new hall call, estimation of the floor where the car changes the running direction, and the current traffic on each floor, are each used as one element of calculation in order to operate the estimated car delay with a high degree of accuracy, as stated above.

However, when all of these elements are contained in the calculation which is performed to obtain estimation with ever-changing complicated traffic taken into consideration, the operation expression of an accurate estimated car delay becomes more complicated. Now that there is a limitation to the human ability, it is difficult to develop new procedures for determining estimated car delay which ensure improved operation accuracy. Furthermore, detailed operation for the estimation increases the time required for the operation and, hence, makes quick allocation of the car and forecasting of the allocated car impossible.

SUMMARY OF THE INVENTION

Accordingly, an object of the present invention is to provide an elevator control apparatus which is directed to overcoming the aforementioned problems of the conventional techniques and which is capable of determining an accurate estimated car delay which is close to an actual car delay by conducting estimation flexibly in accordance with the actual traffic so that an elevator car having minimal delay is allocated to respond to a hall call.

The present invention employs a neural network to estimate a degree of delay for a car to reach a hall where a hall call is placed. Traffic status data such as car positions, directions of travel and hall calls are input to the neural network and the estimated car delay for each car is output therefrom. The actual delay of each car measured and stored as "teacher" data when the car stops at or passes through a hall. The teacher data is used to reconfigure the neural network to reflect changes in building conditions, e.g., traffic status.

In order to achieve the above object, there is provided an elevator control apparatus which comprises:

an input data conversion means for converting traffic data, including a position of a car, a direction of a travel, a car call to be responded, such that it can be used as input data of a neural net;

an estimated car delay operation means including an input layer for taking in the input data, an output layer for outputting the estimated car delay, and an intermediate layer provided between said input and output layers and in which a weighting factor is set, said estimated car delay operation means constituting said neural net; and an output data conversion means for converting the estimated car delay output from said output layer such that it can be used for a predetermined control operation.

DESCRIPTION OF THE PREFERRED EMBODIMENTS

An embodiment of the present invention will now be described with reference to the accompanying drawings.

Figure 1:
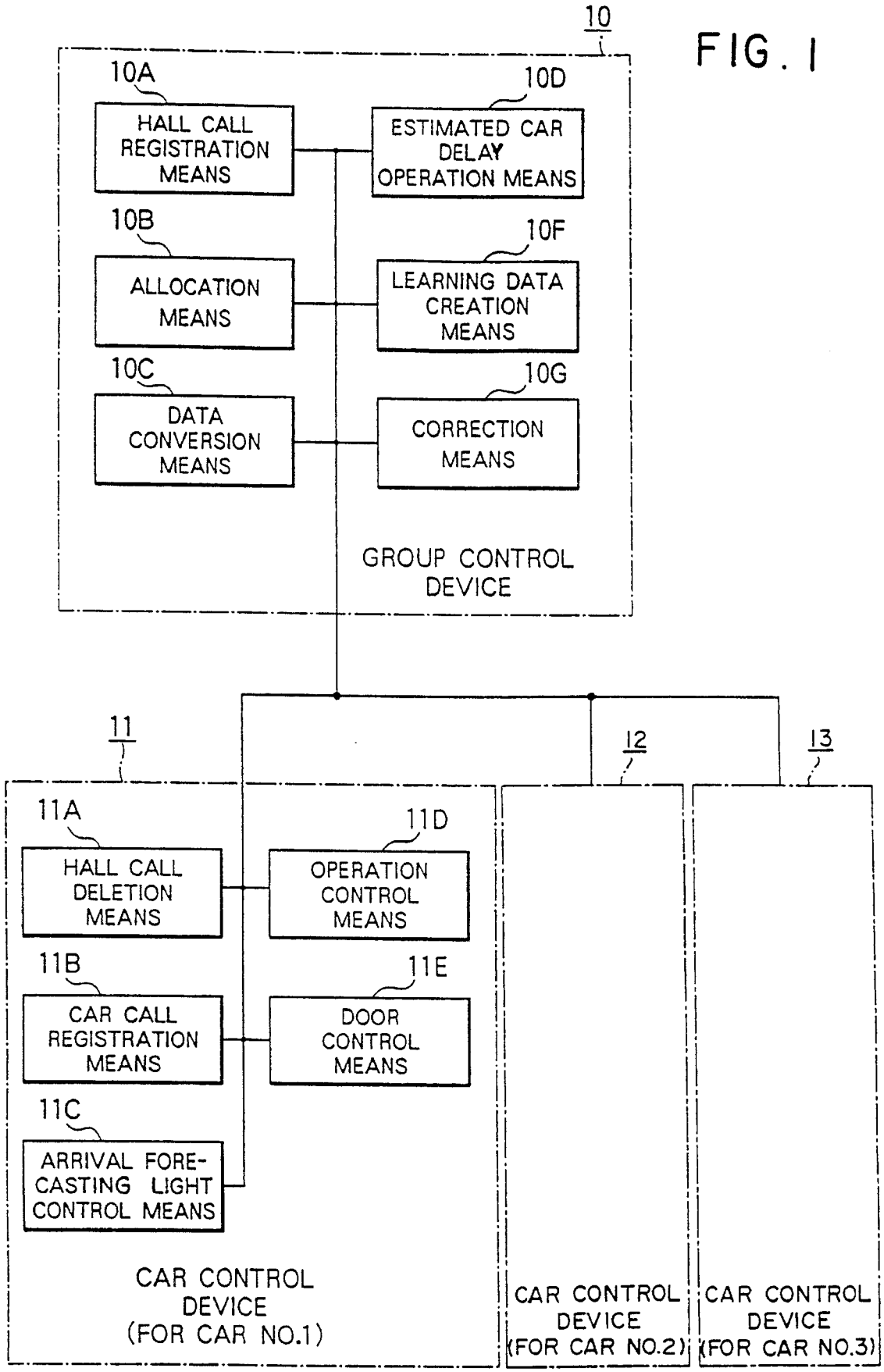
FIG. 1 is a block diagram of a first embodiment of an elevator control apparatus according to the present invention.

Referring first to FIG. 1, a group control device 10 includes a hall call registration means 10A, an allocation means 10B, a data conversion means 10C, an estimated car delay operation means 10D, a learning data creation means 10F, and a correction means 10G. The group control device 10 controls a plurality of car control devices 11 to 13 (for, for example, car Nos. 1, 2 and 3).

The hall call registration means 10A registers and cancels the hall call on each floor (the hall call for ascent or descent), and operates the time which elapses after the hall call is registered (that is, the duration of the hall call).

The allocation means 10B selectively allocates the best car that can be serviced to a hall call. To accomplish this, the allocation means 10B calculates an evaluated value on the basis of the estimated waiting time and the estimated car delay (wrong forecasting probability) for the hall call, and allocates the car which has the minimum evaluated value.

The data conversion means 10C includes an input data conversion means for converting the traffic data, including the car position, direction of the travel, the car load, the call to be responded (car call or hall call to which allocation is made), such that they can be used as input data of the neural net, and an output data conversion means for converting the output data of the neural net (which corresponds to the estimated car delay) such that they can be used for a predetermined control operation (for example, for determining an evaluated value including an estimated waiting time).

As will be described below in detail, the estimated car delay operation means 10D for determining an estimated car delay for each car in accordance with the time zone comprises a neural net including an input layer for taking in input data, an output layer for outputting data corresponding to the estimated car delay, and an intermediate layer provided between the input and output layers and in which weighting factors are set.

The learning data creation means 10F stores the estimated delay for each car, the input data (traffic data) when the estimated car delay is obtained, and the surveyed data (teacher data) on the delay (wrong forecasting probability) of each car, and outputs them as learning data.

The correction means 10G learns and corrects the function of the neural net in the estimated car delay operation means 10D using the learning data.

The car control devices 11 to 13 for car Nos. 1, 2 and 3 have the same configuration. For example, the car control device 11 for car No. 1 is constructed by the following known means 11A to 11E.

The hall call deletion means 11A outputs a hall call deletion signal relative to the hall call made at each floor. The car call registration means 11B registers the car call made relative to each floor. The arrival forecasting lamp control means 11C controls illumination of the arrival forecasting lamp provided at each floor. The operation control means 11D determines the direction of travel of the car and controls the travel and stoppage of the car so that the car can respond to a car call or to a hall call to which the car is allocated. The door control means 11E controls opening and closing of the door of the car.

Figure 2:
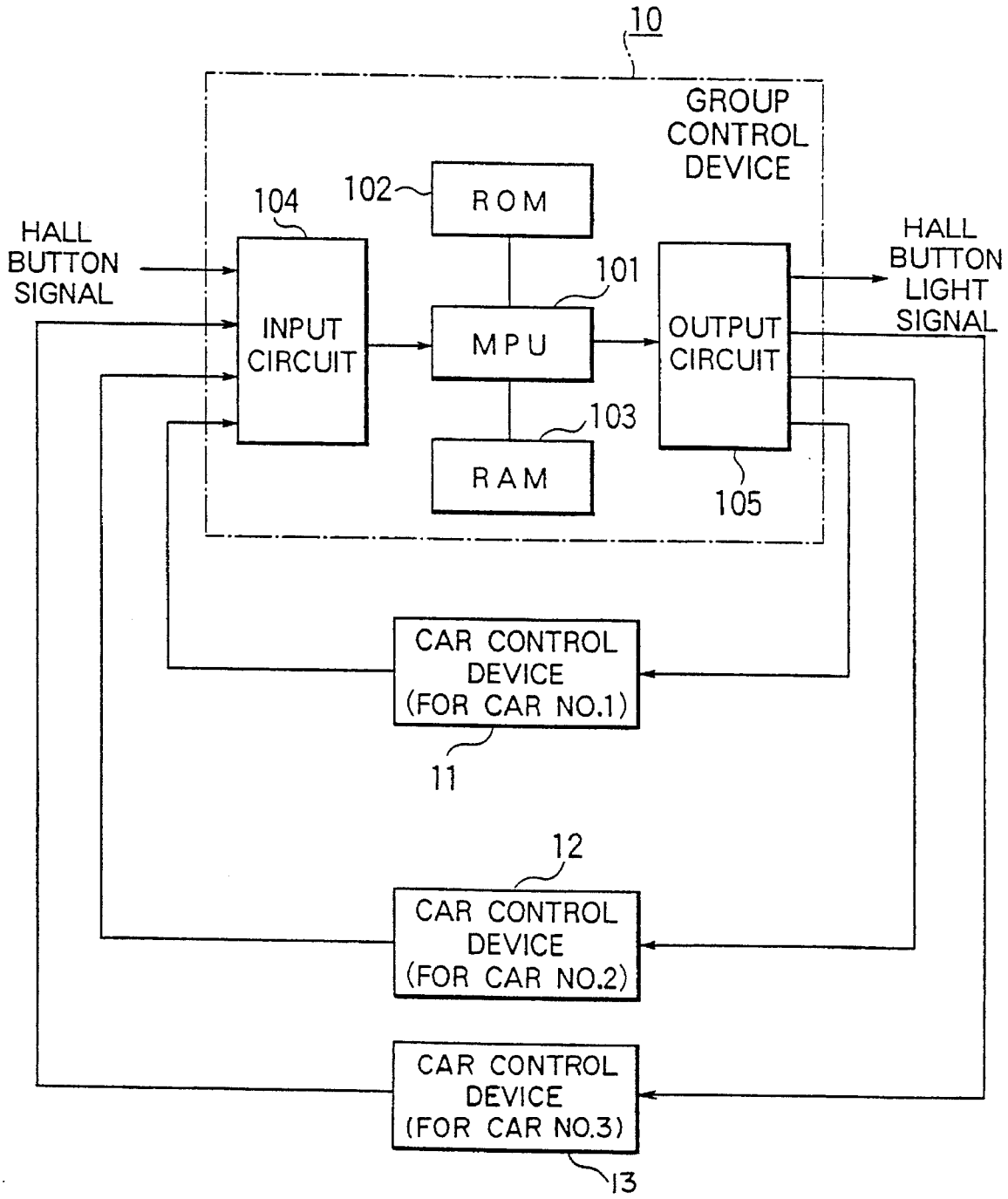
FIG. 2 is a block diagram of a group-control device of FIG. 1.

As shown in FIG. 2, the group control device 10 is a known microcomputer which is composed of a micro processing unit (MPU) or a central processing unit (CPU) 101, a ROM 102, a RAM 103, an input circuit 104, and an output circuit 105.

The input circuit 104 inputs a hall button signal 14 from a hall button provided at each floor, and status signals on the car Nos. 1, 2 and 3 from the car control devices 11 to 13. The output circuit 105 outputs a hall button lamp signal 15 to the hall button lamp incorporated in each hall button. The output circuit 105 also outputs instruction signals to the car control devices 11 to 13.

Figure 3:
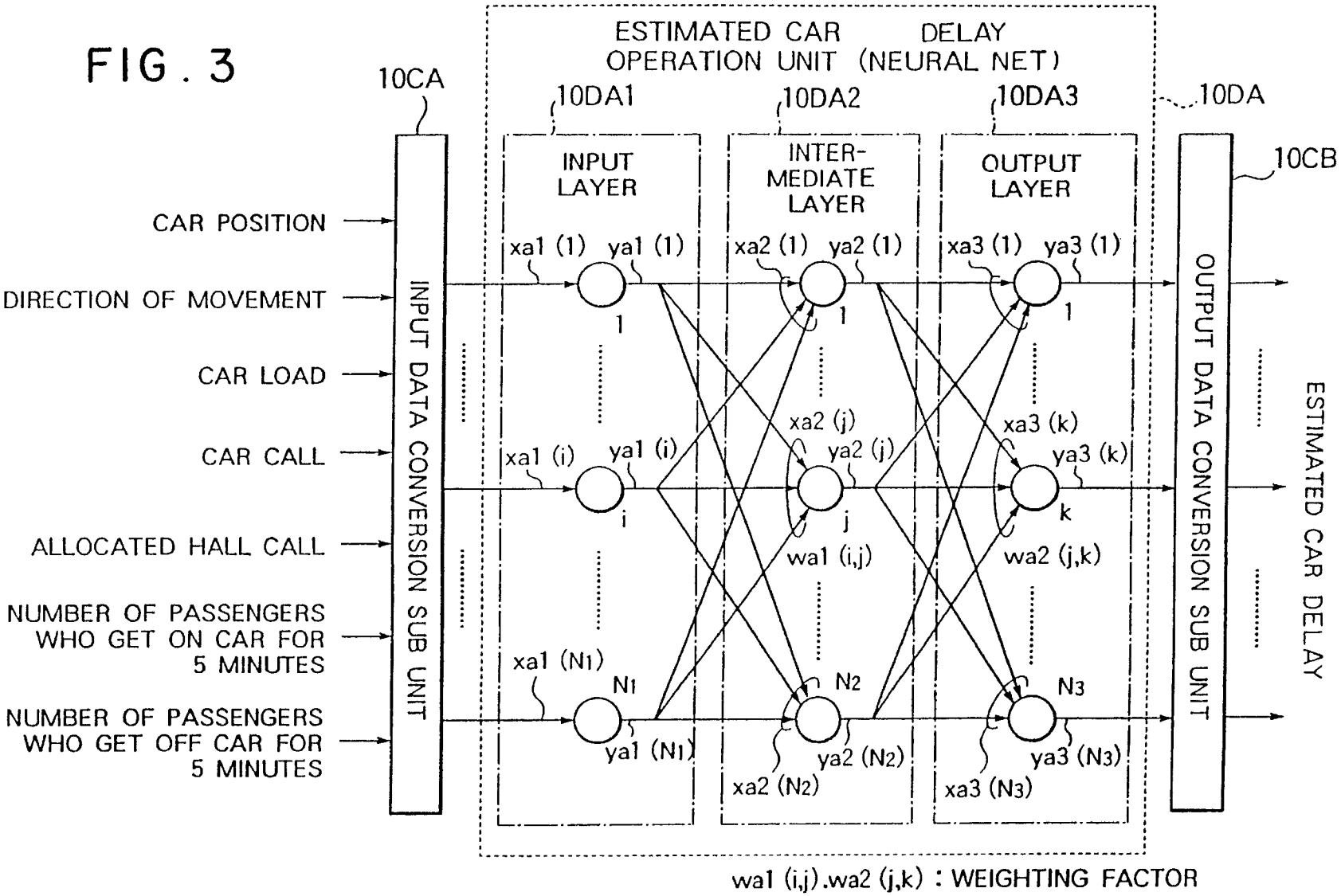
FIG. 3 is a block diagram of a data conversion means and an estimated car delay operation means of FIG. 1.

FIG. 3 is a functional block diagram concretely showing the relation between the data conversion means 10C and the estimated car delay operation means 10D shown in FIG. 1.

The data conversion means 10C includes an input data conversion sub unit 10CA which serves as the input data conversion means and an output data conversion sub unit 10CB which functions as the output data conversion means. An estimated car delay operation unit 10DA consisting of a neural net is inserted between the input data conversion sub unit 10CA and the output data conversion sub unit 10CB. The estimated car delay operation unit 10DA constitutes the estimation operation sub routine used in the estimated car delay operation means 10D shown in FIG. 1.

The input data conversion sub unit 10CA converts the traffic data, including the car position, direction of the travel, the car load, the car call and the hall call to which the car is allocated, the statistic features of the traffic (the number of people who get on the car for five minutes and the number of people who get off the car for five minutes), such that they can be used as the input data to the neural net 10DA.

The output data conversion sub unit 10CB converts the output data (corresponding to the estimated car delay) of the neural net 10DA such that they can be used for the operation of the evaluated value for the hall call allocation operation, or control data.

The estimated car delay operation unit 10DA which consists of the neural net is made up of an input layer 10DA1 for taking in the input data from the input data conversion sub unit 10CA, an output layer 10DA3 for outputting data corresponding to the estimated car delay, and an intermediate layer 10DA2 provided between the input and output layers 10DA1 and 10DA3 and in which weighting factors are set. The layers 10DA1 to 10DA3 are connected to each other by the network, and are each constructed by a plurality of nodes.

Let the numbers of nodes of the input layer 10DA1, intermediate layer 10DA2 and output layer 10DA3 be respectively N1, N2 and N3. Then, the number of nodes N3 of the output layer 10DA3 is expressed as follows:

$$N3=2\ (FL-1)$$

where FL is the number of floors in a building. The number of nodes N1 of the input layer 10DA1 and the number of nodes N2 of the intermediate layer 10DA2 are respectively determined in accordance with the number of floors FL of the building, the types of input data used, the number of cars and so on.

When variables i, j and k are respectively i=1, 2, . . . , N1 j=1, 2, . . . , N2 k=1, 2, . . . , N2 the input and output values of the ith node of the input layer 10DA1 are expressed by xa1(i) and ya1(i), the input and output values of the jth node of the intermediate layer 10DA2 are expressed by xa2(j) and ya2(j), and the input and output values of the kth node of the output layer 10DA3 are expressed by xa3(k) and ya3(k).

When the weighting factor between the ith node of the input layer 10DA1 and the jth node of the intermediate layer 10DA2 is wa1(i, j) and the weighting factor between the jth node of the intermediate layer 10DA2 and the kth node of the output layer 10DA3 is wa2(j, k), the relations between the input and output values of the individual nodes are expressed as follows:

$$ya1(i) = 1/[1 + \exp\{-xa1(i)\}] \quad (1)$$

$$xa2(j) = \sum_{i=1}^{N1} \{wa1(i, j) \times ya1(i)\} \quad (2)$$

$$ya2(j) = 1/[1 + \exp\{-xa2(i)\}] \quad (3)$$

$$xa3(k) = \sum_{j=1}^{N2} \{wa2(j, k) \times ya2(j)\} \quad (4)$$

$$ya3(k) = 1/[1 + \exp\{-xa3(k)\}] \quad (5)$$

where $0 \leqq wa1(i,j) \leqq 1$ and $0 \leqq wa2(j,k) \leqq 1$.

The group control operation conducted in this embodiment will be described below with reference to the flowchart shown in FIG. 4.

First, the group control device 10 takes in the hall button signal 14 and the status signals from the car control devices 11 to 13 in accordance with a known input program in step 31. The status signal input to the group control device 10 contains the car position, direction of the travel, stoppage or travel, the door opened/closed state, the car load, the car call, and the hall call deletion signal.

Next, in step 32, the hall call is registered or cancelled, illumination of the hall button lamp is determined, and the duration of the hall call is determined in accordance with a known hall call registration program.

Next, in step 33, it is determined whether or not a new hall call C is registered. If the answer is yes, an elevator car is virtually allocated to the hall call. That is, a car is allocated to the hall call for the purposes of determining the estimated car delay. The program of estimating the car delay when car No. 1 is virtually allocated is executed in step S34 to determine an estimated car delay Ta1(k) of car No. 1 relative to each hall k (=1, 2, . . . , N3) when the new hall call C is virtually allocated to car No. 1.

Similarly, in step 35, the program of estimating the car delay when car No. 2 is virtually allocated is executed to determine an estimated delay Ta2(k) of car No. 2 relative to each hall k (=1, 2, . . . , N3) when the new hall call C is virtually allocated to car No. 2. Subsequently, the program of estimating the delay when car No. 3 is virtually allocated is executed in step S36 to determine an estimated delay Ta3(k) of car No. 3 relative to each hall k (=1, 2, . . . , N3) when the new hall call C is virtually allocated to car No. 3.

In subsequent steps 37 and 39, the program of estimating the car delay when the new hall call C is ignored and is not allocated to car No. 1, No. 2 or No. 3 (at the time of non-allocation) is executed to determine the estimated delay Tb1(k) to Tb3(k) of car Nos. 1 to 3 relative to each hall.

Next, in step 40, the allocation program is executed to determining evaluated values W1 to W3 on the basis of the estimated car delay Ta1(k) to Ta3(k) and Tb1(k) to Tb3(k) operated in steps 34 to 39, and a car which has the minimum evaluated value is selected as a car to be actually allocated that is, the car having the minimum evaluated value is the car selected to respond to the hall call. An allocation instruction and a forecasting instruction, corresponding to the hall call C, are assigned to the car to be allocated. The evaluated values W1 to W3 may be determined using the method described in, for example, Japanese Patent Publication No. 48464/1983.

Next, in step 41, the output program is executed to send out the hall button lamp signal 15 set in the manner described above to the corresponding hall and to send out the allocation signal and the forecasting signal to the car control device 11, 12 or 13.

Next, in step 42, the learning data creation program is executed to store the converted traffic data, the estimated car delay for each hall and the surveyed data on the delay for each car and then to output the data as learning data.

In step 43, the correction program is executed to correct the weighting factors for the network in the estimated car delay operation means 10D using the learning data.

The group control device 10 performs group control over the plurality of elevator cars by executing the processings from step 31 to step 43 repetitively.

If it is determined in step 33 that the new hall call C is not registered, the process goes from step 33 to step 41.

Figure 5:
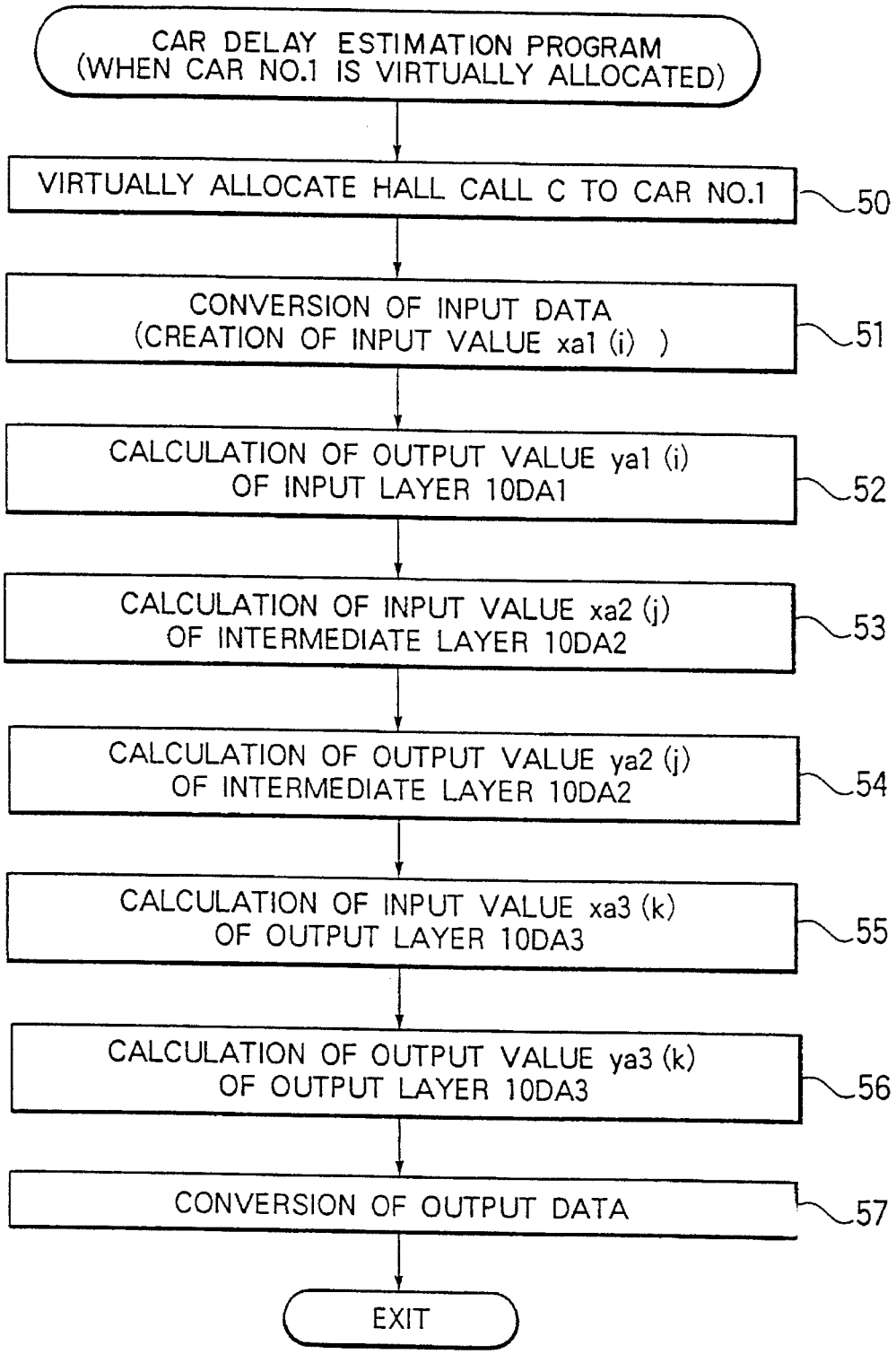
FIG. 5 is a flowchart showing a car delay estimation operation program executed in FIG. 4 when the car is virtually allocated to a hall call.

Next, the operation of the car delay estimation program executed in the process of steps 34 to 39 will be described concretely with reference to FIG. 5. Here, the process of step 34 will be described as the typical example.

First, in step 50, the new hall call C is virtually allocated to car No. 1, and allocated hall call data to be input to the input data conversion sub unit 10CA is created.

In steps 35 and 36, the new hall call C is virtually allocated to car Nos. 2 and 3, and corresponding allocated hall call data is created. In the processes of steps 37 to 39, allocated hall call data when no allocation is made is used as the allocated hall call data.

Next, in step 51, the data on the car on which the estimated car delay is to be determining (including the car position, direction of travel, the car load, the car call and the allocated hall call) and the data representing the statistical features of the traffic at the present time are taken out from among the traffic data which is input, and this data is converted into data xa1(1) to xa1(N1) that can be input to the individual nodes of the input layer 10DA1 of the estimated car delay operation unit 10DA. Here, the car load represents the ratio of the car load to the rated load.

If the number of floors FL of the building is twelve and if the hall No. f=1, 2, . . . , 11 respectively represent the ascending halls on the first, second, . . . , eleventh floors while the hall No. f=12, 13, . . . , 22 respectively represent the descending halls on the twelfth, eleventh, . . . second floors, the state of a car "in which the car positioned floor is f and in which the direction of travel is ascent" is expressed as follows:

xa1(f)=1 xa1(i)=0

(i=1, 2, . . . 22, i≠f)

The state of the car is expressed using a value normalized within a range from 0 to 1. The car load xa1(23) is normalized to a value ranging from 0 to 1 by dividing it by the maximum value NTmax (for example, 120%) that the car load xa1(23) can take.

"1" is assigned to the car calls, xa1(24) to xa1(35), made relative to the first to twelfth floors when they are registered, and "0" is assigned to the car calls when they are not registered. "1" is assigned to the ascending hall calls, xa1(36) to xa1(46), made on the first to eleventh floors when they are allocated, and "0" is assigned to the ascending hall calls when they are not allocated. "1" is assigned to the descending hall calls, xa1(47) to xa1(57), made on the twelfth to second floors when they are allocated, and "0" is assigned to them when they are not allocated.

The numbers of passengers, xa1(58) to xa1(68), who get on the ascending car for five minutes on the first to eleventh floors are normalized to a value ranging from 0 to 1 by dividing the numbers of passengers per five minutes obtained from the statistics of the past traffic by the maximum value NNmax (for example, one hundred passengers) that the numbers of passengers can take. The numbers of passengers, xa1(69) to xa1(79), who get on the descending car for five minutes on the twelfth to second floors, the numbers of passengers, xa1(80) to xa1(90), who get off the ascending car for five minutes on the first to eleventh floors, and the numbers of passengers, xa1(91) to xa1(101), who get off the descending car for five minutes on the twelfth to second floors are respectively normalized by dividing the numbers obtained by the statistics by the maximum value NNmax.

The method of normalizing the input data is not limited to the above-described method but the car position and the direction of the travel may be expressed separately. For example, the input value xa1(1) of the first node which represents the car positioned floor when the car positioned floor is f may be expressed by $$xa1(1)=f/FL$$

"+1" may be assigned to the input value xa1(2) of the second node which represents the direction of the travel of the car when the car ms ascending, "−1" may be assigned to the input value xa1(2) when the car is descending, and "0" may be assigned to the input value xa1(2) when the car is moving in no direction.

Once the input data to be input to the input layer 10DA1 is set in step 51, the network operation for estimating the car delay when the new hall call C is virtually allocated to car No. 1 is performed in steps 52 to 56.

First, in step 52, the output value ya1(i) of the input layer 10DA1 is determined using by Equation (1) and the input data xa1(i).

Subsequently, in step 53, the input value xa2(j) of the intermediate layer 10DA2 is determined using Equation (2) by multiplying the output value ya1(i) obtained by Equation (1) by the weighting factor wa1(i, j) and by totalling the resultant values regarding i=1 to N1.

Next, in step 54, the output value ya2(j) of the intermediate layer 10DA2 is determined by Equation (3) using the input data xa2(j) obtained by Equation (2).

Subsequently, in step 55, the input value xa3(k) of the output layer 10DA3 is determined by Equation (4) by multiplying the output value ya2(j) obtained by Equation (3) by the weighting factor wa2(j, k) and by totalling the resultant values regarding j=1 to N2.

Thereafter, in step 56, the output value ya3(k) of the output layer 10DA3 is operated by Equation (5) using the input value xa3(k) obtained by Equation (4).

Once the network operation on the estimated car delay is completed, the output data conversion sub unit 10CB shown in FIG. 1 converts the output values ya3(1) to ya3(N3) in step 57 to determine the final estimated car delay (wrong forecasting probability).

At that time, the individual nodes of the output layer 10DA3 correspond to the halls for opposite directions: the output values ya3(1) to ya3(11) of the first to eleventh nodes are respectively used to determine the values of the estimated car delay for the ascending halls on the first, second, . . . , eleventh floors, and the output values ya3(12) to ya3(22) are respectively used to determine the values of the estimated car delay for the descending halls.

Since the output value ya3(k) (k=1, 2, . . . , N3) of the kth node has already been normalized to a value ranging from 0 to 1, it can be used as it is for determining the evaluated value of the hall call allocation. Hence, the estimated car delay T (k) for the hall k is expressed as follows.

$$T(k)=ya3(k) \tag{6}$$

In the car delay estimation program, the relation of cause and effect between the traffic and the estimated car delay is expressed in the form of a network, and the traffic data is taken into the neural net in order to determine an estimated car delay. In consequence, an estimated car delay which is very close to an actual wrong forecasting probability can be obtained with a high degree of accuracy that cannot be realized by the conventional methods. Furthermore, since the car to be allocated to the hall call is selected on the basis of the estimated car delay obtained in the above-described manner, occurrence of wrong forecasting can reliably be suppressed, the waiting time for the hall call can be shortened, and confusion can be avoided.

However, since the network changes as a consequence of changes in the weighting factors wa1(i, j) and wa2(j, k) which connect the individual nodes in the neural net 10DA, the weighting factors wa1(i, j) and wa2(j, k) must be appropriately changed and corrected through learning so as to achieve determination of more adequate estimated car delay.

Next, the operations performed when the learning data creation and correction programs (steps 42 and 43) are executed by the learning data creation and correction means 10F and 10G will be described with reference to FIGS. 6 and 7. Learning (correction of the network) is effectively performed using the back propagation method. The back propagation method is a method of correcting the weighting factors which connect the network using errors between the output data of the network and desired output data (teacher data) created from surveyed data or control objective values.

Figure 6:
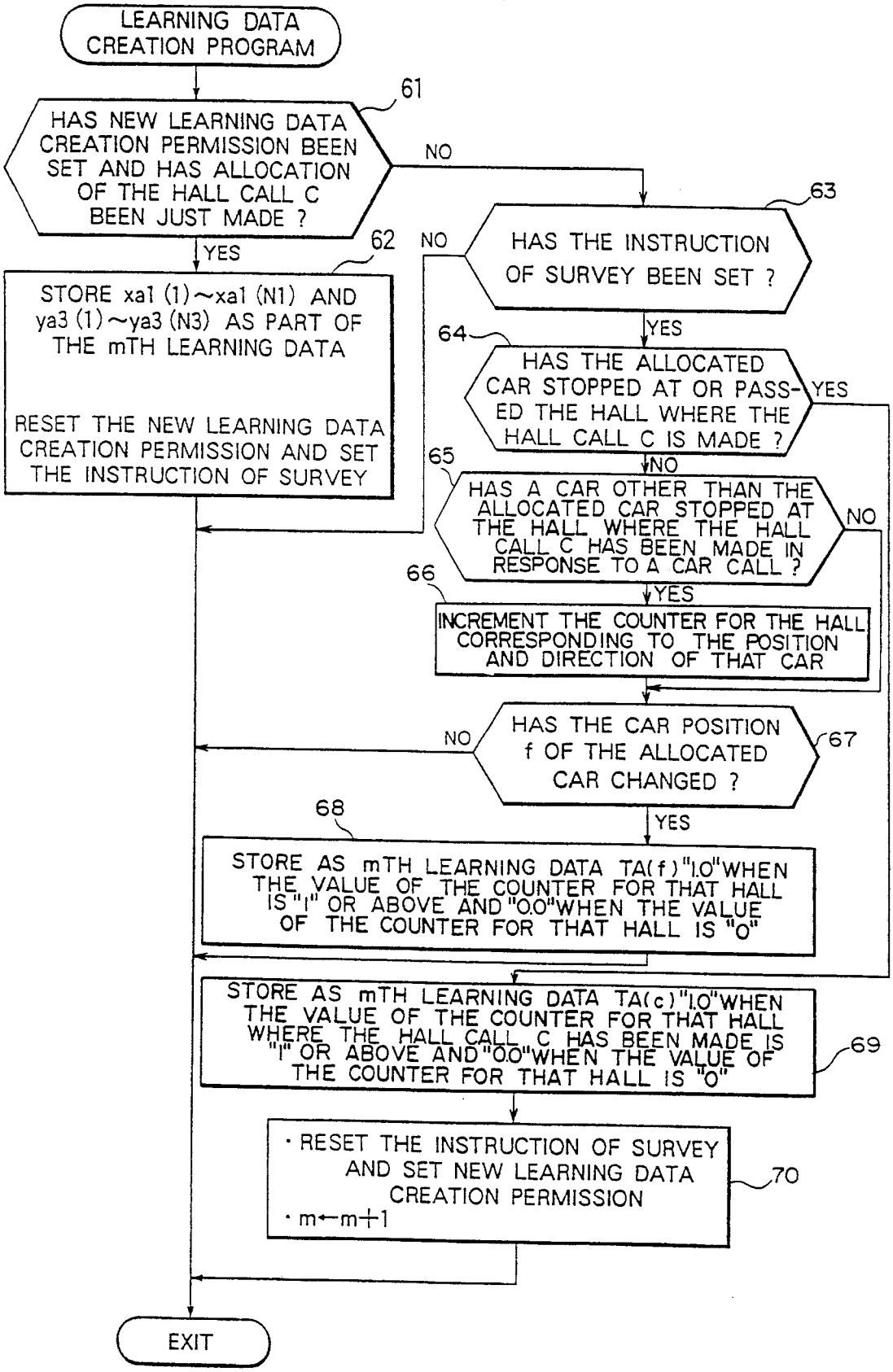
FIG. 6 is a flowchart showing a learning data creation program executed in FIG. 4.

In the flowchart of the learning data creation program shown in FIG. 6, it is determined in step 61 whether or not the new learning data creation has been permitted and whether or not allocation of the new hall call C has just been made.

If the learning data creation has been permitted and if allocation of the hall call C has been made, the traffic data xa1(1) to xa1(N1) on the allocated car when allocation is made and the output data ya3(1) to ya3(N3) corresponding to the estimated car delay on the individual halls are stored as part of the mth learning data (teacher data) in step 62. Also, permission of creation of new learning data is reset, instruction of surveying the actual car delay is set, and the counters provided on all the floors for counting the number of cars which arrive at that floor are reset to '0'.

Hence, it is determined in step 61 in the subsequent operation cycle that the new learning data creation is not permitted, and the process goes to step 63 where it is determined whether or not the instruction of surveying the car delay is set. Since the survey instruction has already been set in step 62, the process goes to step 64 and it is determined whether or not the allocated car has responded to the hall call C (whether or not the allocated car has stopped at or passed the floor where the hall call C has been made).

If the allocated car has not stopped at the hall where the hall call C has been made, it is determined in step 65 whether or not the car other than the car allocated to the hall call C has responded to the hall call and stopped at the hall where the hall call C has been made.

If it is determined that the car other than the car allocated to the hall call C has responded to the car call and stopped in step 65 in a subsequent operation cycle, the counter for counting the number of cars which arrive, corresponding to the position and direction of that car, is incremented in step 66, and then it is determined in step 67 whether or not the car position f of the allocated car has changed. If it is determined in step 65 that the car other than the car allocated to the hall call C has not stopped, the process goes directly to step 67.

If the change in the car position f is detected in a subsequent operation cycle, presence or absence of the wrong forecasting is stored as part of the mth learning data in step 68. This is the original teacher data and is expressed by the actual car delay TA(f) at the hall represented by the car position f. The value of the counter represents the number of cars which arrive faster at the hall represented by the car position f of the allocated car in response to the hall call. Thus, when the number set in the counter is "1" or above, which means that, if the hall call of the call represented by the car position f has been registered and if the car has been allocated to that hall call, forecasting will have proved wrong, "1" is assigned to the actual car delay TA(f). When the value set in the counter is "0", "0" is assigned to the actual car delay TA(f).

If it is determined in step 64 that the allocated car has stopped at the hall where the hall call C has been made in a subsequent operation cycle, the process proceeds to step 69 and the actual car delay TA(C) obtained when the detection is made is stored as part of the mth learning data. Subsequently, the instruction of surveying the actual car delay is reset, learning data No. m is incremented, and creation of new learning data is permitted in step 70.

Thus, the input and output data on the allocated car, as well as the presence or absence of the actual wrong forecasting (actual car delay) for the individual halls the allocated car stops or passes by the time it responds to the hall call C, are repeatedly created and stored as the learning data each time allocation to the hall call is made.

Figure 4:
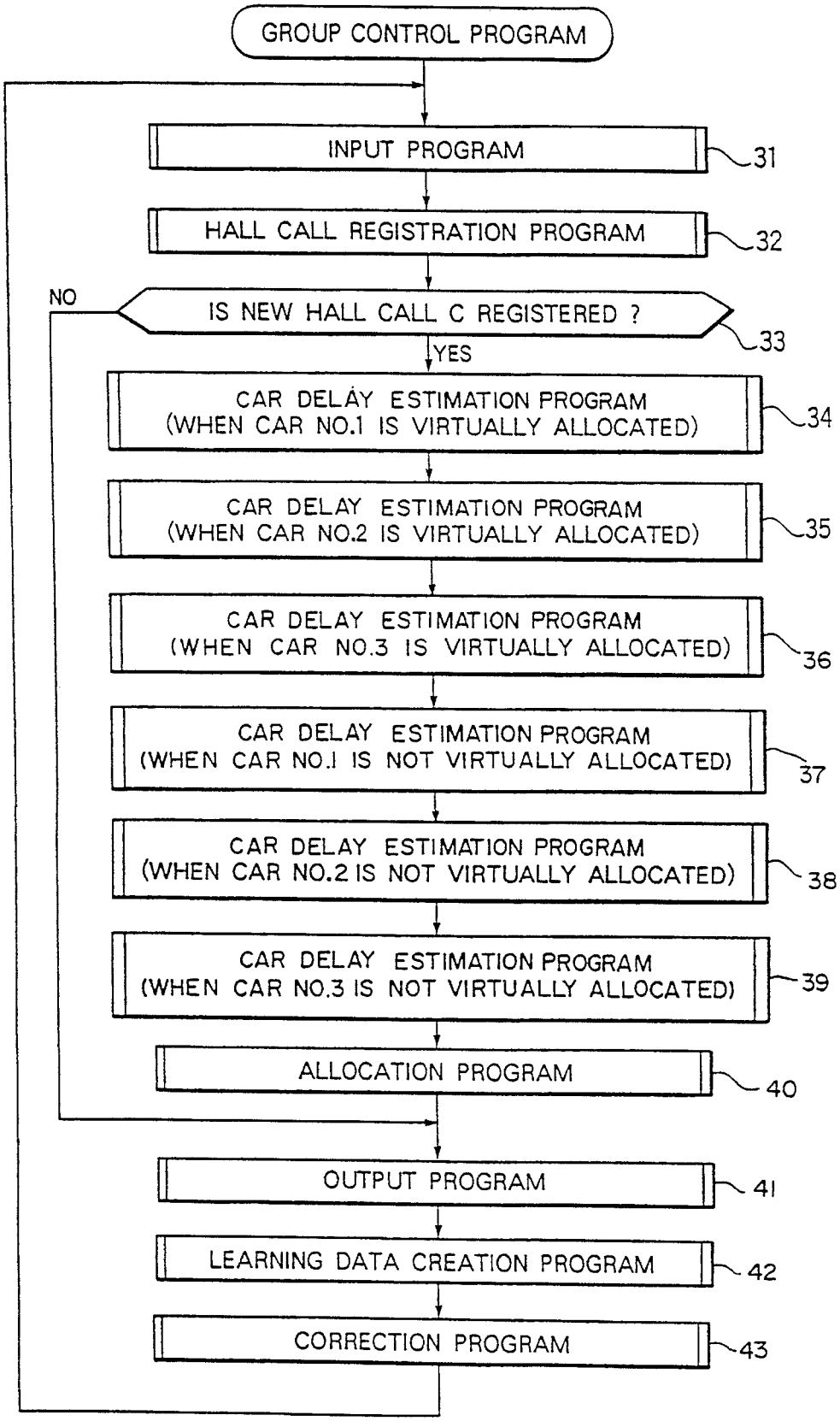
FIG. 4 is a flowchart showing a group control program executed in the first embodiment.

Next, the correction means 10G executes the correction program shown in FIG. 4 (step 43) and thereby corrects the neural net 10DA using the learning data.

The correction operation performed by the correction means will now be described in detail with reference to FIG. 7.

First in step 71, it is determined whether or not it is an appropriate time for correction of the network to be made. If the answer is yes, the processes of steps 72 to 78 are executed.

In this embodiment, correction of the network is made when the number m of learning data sets has reached S (for example, 500). The reference number S for the learning data may be set in accordance with the scale of the network, such as the number of elevators installed, the number of floors FL of the building, and the number of hall calls.

If it is determined in step 71 that the number m of learning data sets has reached S, the counting No. n of the learning data is initialized to '1' in step 72. Thereafter, in step 73, the actual car delay TA(1) to TA(N3) is taken out from among the nth learning data, and the value of the node corresponding to the hall for the actual car delay, i.e., the teaching data da(k) (k=1, 2, . . . , N3), is obtained by the following equation:

$$da(k)=TA(K)/NTmax \tag{7}$$

Next, the error Ea between the output value ya3(1) to ya3(N3) of the output layer 10DA3 taken out from among the nth learning data and the teacher data da(1) to da(N3) is obtained by the following equation:

$$Ea=\sum_{k=1}^{N3}[\{da(k)-ya3(k)\}^2]/2 \tag{8}$$

In step 74, the weighting factor wa2 (j, k) (j=1, 2, . . . , N2, k=1, 2, . . . N3 ) between the intermediate layer 10DA2 and the output layer 10DA3 is corrected using the error Ea obtained from Equation (8) in the manner described below:

First, variation Δwa2(j, k) in the weighting factor expressed by the following equation is obtained by differentiating the error Ea obtained by Equation (8) by wa2(j, k) and then by re-arranging the resultant value using Equations (1) to (5):

$$\begin{aligned}\Delta wa2(j,k) &= -\alpha\{\partial Ea/\partial wa2(j,k)\} \\ &= -\alpha\cdot\delta a2(k)\cdot ya2(j)\end{aligned} \tag{9}$$

where α is a parameter which represents the learning rate. A given value ranging from 0 to 1 is assigned to α. In equation (9), $$\delta a2(k)=\{ya3(k)-da(k)\}ya3(k)\ \{1-ya3\ (k)\}$$

Once the variation Δwa2(j, k) of the weighting factor wa2(j, k) has been calculated, the weighting factor wa2(j, k) is corrected as follows:

$$wa2(j,k)\leftarrow wa2(j,k)+\Delta wa2(j,k) \tag{10}$$

Thereafter, the weighting factor wa1(i, j) (i=1, 2, . . . , N1, j=1, 2, . . . , N2 ) between the input layer 10DA1 and the intermediate layer 10DA2 is corrected similarly in step 75 in accordance with the following Equations (11) and (12).

First, variation Δwa1(i, j) of the weighting factor wa1(i, j) is obtained by the following equation:

$$\Delta wa1(i,j)=-\alpha.\delta a1(j).ya1(i) \tag{11}$$

where δa1(j) is expressed as follows:

$$\delta a1(j)=\sum_{k=1}^{N3}\{\delta a2(k)\cdot wa2(j,k)\cdot ya2(j)x[1-ya2(j)\}$$

The weighting factor wa1(i, j) is corrected using the variation Δwa1(i, j) obtained by Equation (11) as follows:

$$wa1(i,j)\leftarrow wa1(i,j)+\Delta wa1(i,j) \tag{12}$$

In steps 74 and 75, only the weighting factors associated with the halls whose teacher data is present are corrected. That is, since only the actual degrees of delay associated with the halls located between the car position when the allocation is made and the hall where the hall call C has been made are stored as the teacher data, as stated above, correction of the weighting factors associated with the halls other than those is not made.

Once correction has been made using the nth learning data in steps 73 to 75, the learning data No. n is incremented in step 76, and the processes from step 73 to 76 are then repeated until it is determined in step 77 that correction has been made on all the learning data (until n≧ m).

Once correction on all the learning data has been completed, the corrected weighting factors wa1(i, j) and wa2(j, k) are registered in the estimated car delay operation means 10D in step 78.

At that time, all the learning data used for correction is cleared so that new learning data can be stored, and the learning data No. m is then initialized to "1", thereby completing the network correction (learning) for the neural net 10DA.

Thus, the learning data is created on the basis of the surveyed values, and the weighting factors wa1(i, j) and wa2(j, k) for the estimated car delay operation means 10D are respectively corrected using the learning data. It is therefore possible to automatically cope with changes in the traffic in the building.

Furthermore, since the statistically obtained numbers of passengers who get on and get off the elevator on each hall for five minutes are used as the input data representing the traffic features, more flexible and accurate estimation can be made relative to an ever-changing traffic as compared with the case in which the car position, the direction of the travel, the car load and the call to be responded alone are used as the input data.

In the above embodiment, the wrong forecasting probability is used as the estimated car delay. However, any index which indicates the delay of the car, such as the estimated value of the turn in which the car arrives or estimated delay time representing the estimated value of how much arrival will be delayed from the first arrived car, may also be used as the estimated car delay.

In a case where, for example, the estimated value of the turn in which the car arrives is used as the estimated car delay, the output values ya3(1) to ya3(11) of the first to eleventh nodes in the output values ya3(1) to ya3(N3) of the output layer 10DA3 of the neural net 10DA are respectively made to correspond to the turns in which the car arrives at the respective ascending halls on the first to eleventh floors, and the output values ya3(12) to ya3(22) of the twelfth to twenty-second nodes are respectively made to correspond to the turns in which the car arrives at the respective descending halls on the twelfth to second floors. The output value ya3(k) (k=1, 2, . . . , N3) of the the node k is converted into the estimated car delay T(k) for the hall k by the following equation:

$$T(k)=ya3(k)\times NRmax \tag{13}$$

At that time, since the output value ya3(k) of the node k has been normalized to a value ranging from 0 to 1, it is multiplied by the maximum value NRmax (e.g., the number of cars which are under group control) when it is used for the determination of the estimated value for the hall call allocation.

Figure 8:
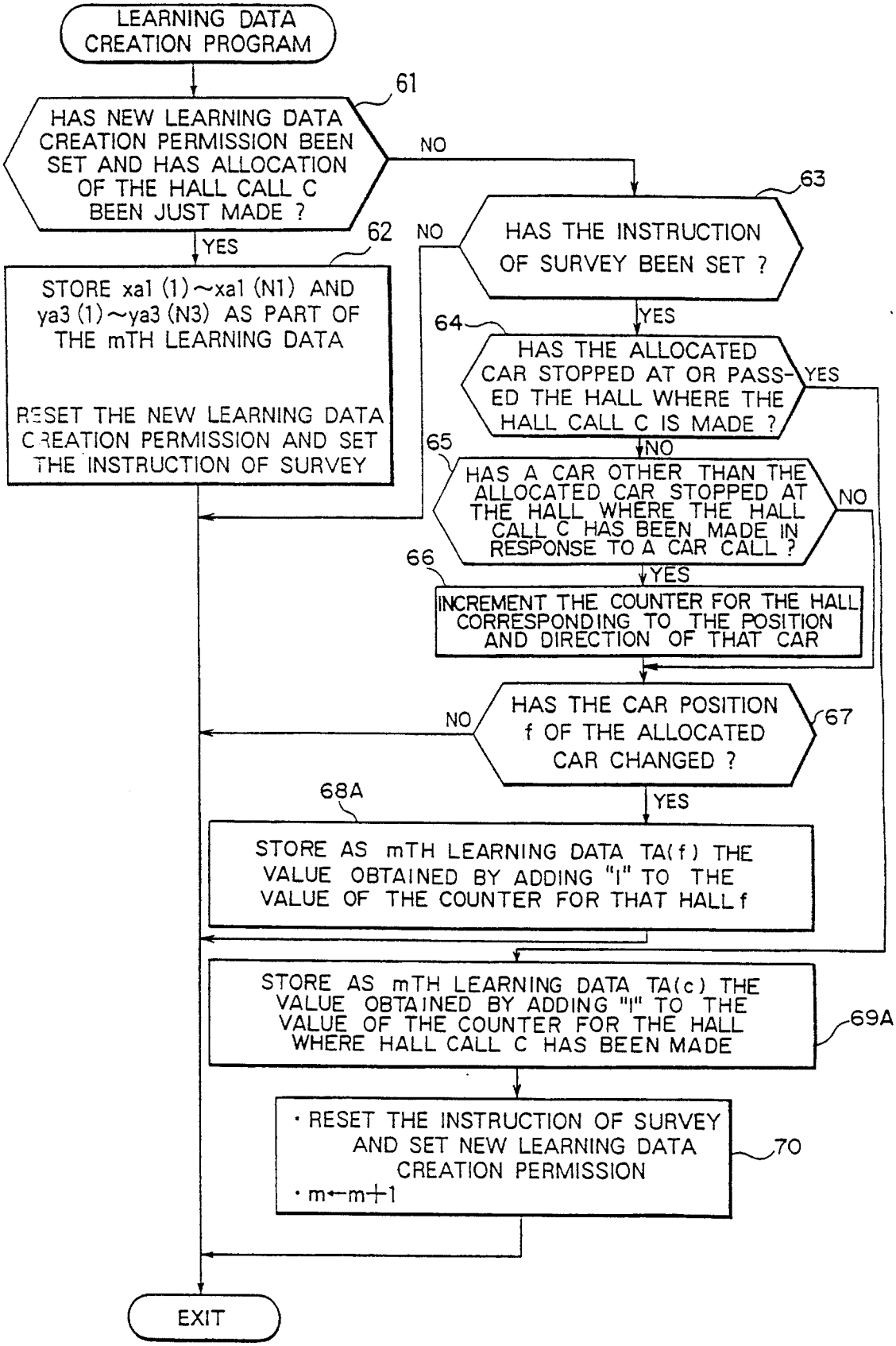
FIG. 8 is a flowchart showing the learning data creation program executed in a second embodiment of the present invention.

FIG. 8 is a flowchart of the operation of the learning data creation program executed when the estimated value of the sequence in which the car arrives is used as the estimated car delay.

In the learning data creation program shown in FIG. 8, all the steps coincide with those shown in FIG. 6 except for steps 68A and 69A. In this program, the value of the counter provided on each hall for counting the number of cars which arrive, represents the number of cars which arrive at the hall represented by the car position f of the allocated car, faster than the allocated car in response to the car call after allocation has been made to the hall call C. Therefore, in steps 68A and 69A, the value (the turn in which the car arrives) obtained by adding "1" to the value of the counter is stored as the original teacher data TA(f).

Figure 7:
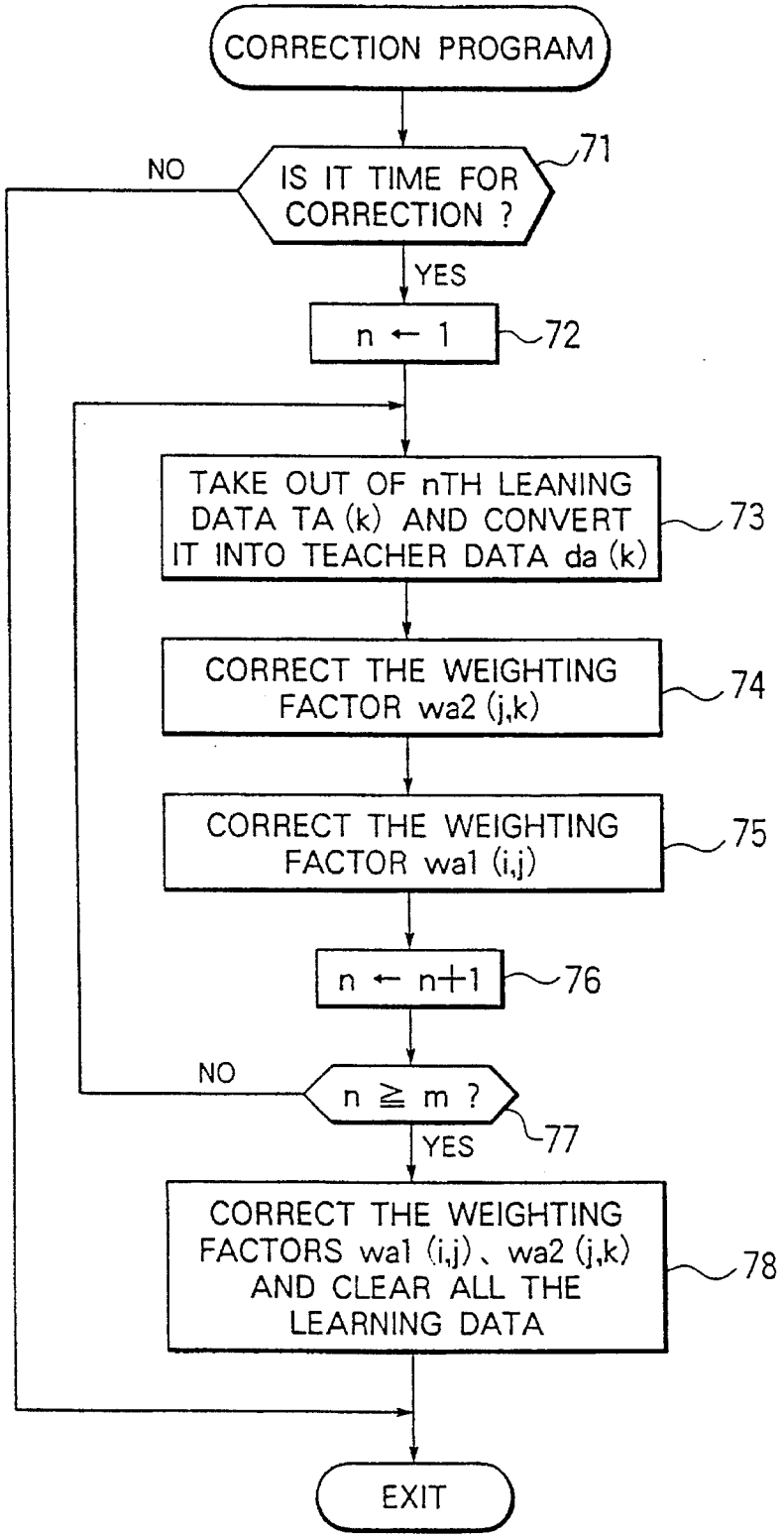
FIG. 7 is a flowchart showing a correction program executed in FIG. 4.

Thereafter, the correction program shown in FIG. 7 is executed using the learning data created in the manner described in FIG. 8 so as to correct the weighting factors. In that case, the learning data is converted into the teacher data da(k) as follows:

$$da(k)=TA(k)/NRmax \tag{14}$$

In a case where the estimated value of the car delay time is used as the estimated car delay, the output values ya3(1) to ya3(11) of the first to eleventh nodes in the output values ya3(1) to ya3(N3) (see FIG. 3) of the output layer 10DA3 of the neural net 10DA are respectively made to correspond to the delay times at the respective ascending halls on the first to eleventh floors, and the output values ya3(12) to ya3(22) of the twelfth to twenty-second nodes are respectively made to correspond to the delay times at the respective descending halls on the twelfth to second floors. The output value ya3(k) of the the node k is converted into the estimated car delay T(k) for the hall k by the following equation:

$$T(k)=ya3(k)\times NTmax \tag{15}$$

At that time, NTmax represents the fixed maximum delay time which can occur. NTmax is set to, for example, 100 seconds.

When the estimated value of the delay time is used as the estimated car delay, the learning data is created in the manner described in FIG. 6 or 8. In this case, the learning data is the delay time counted from the arrival of the first arrived car. The learning data is converted into the teacher data by the following equation:

$$da(k)=TA(k)/\mathrm{NTmax} \tag{16}$$

In the above-described embodiments, the input data conversion means performs conversion on the car position, direction of the travel, the car load, and the calls to be responded. However, the traffic data used as the input data is not limited to the above-described ones. For example, the status of the car (the speed is being decreased, the door opening operation is being made, the door is being opened, the door closing operation is being made, the car is waiting with its door closed, and the car is moving), the duration the hall call, the time during which the hall call is made and the number of cars on which group control is performed may also be used as the input data. Furthermore, not only the current traffic data but also the traffic data in the recent past (the history of the car's movement or that of the cat's response to the call) may also be used as the input data. In this way, a more accurate calculation of the estimated car delay is made possible.

Furthermore, the learning data creation means 10F stores as the learning data set the estimated car delay of the allocated car relative to each hall, the input data when allocation to the hall call is made, and the actual car delay for each hall at which the allocated car stops or passes before it responds to the hall call when allocation of the hall call is made. However, the learning data may be created at other times. For example, the learning data may be created a predetermined period of time (for example, one minute) after the previous input data has been stored. Alternatively, the learning data may be created cyclically (for example, at intervals of one minute). Since the learning conditions are improved as the number of learning data obtained under various conditions increases, the learning data may also be created when any of previously determined typical statuses of the car are detected, e.g., when the car is stopped at a predetermined floor or when the car is in a predetermined state (the speed is being decreased, the car is at a stop, and so on).

Furthermore, in the above-described embodiments, the learning data creation means 10F stores as the teaching data only the actual car delay for each floor at which the allocated car stops or passes by the time it responds to the allocated hall call, and the correction means 10G performs correction only on the weighting factor which is associated with the stored teaching data. However, the method of extracting the teaching data is not limited to the above-described one. For example, the estimated car delay for all the halls and the actual car delay that can be measured during the movement of the car may be stored, and only the weighting factors associated with the halls on which the teacher data is present may be corrected. The halls whose actual car delay cannot be measured correspond to those which are located farther than the floor at which the direction of the movement of the car is reversed when the car changes the direction of travel before it reaches the objective floor. In addition, these halls correspond to those located farther than the floor at which the car becomes empty in a case where the car (to which no hall call is allocated) becomes empty before it reaches the objective floor, and to those located beyond the floor (for example, those located below the present position of the car when the car is ascending) at which the car is positioned when the input data is stored.

Furthermore, the estimated car delay operation means 10D corrects the weighting factor each time the number of stored learning data reaches a predetermined number. However, the time at which the weighting factor is corrected is not limited to the above-described one. For example, the weighting factor may be corrected at a predetermined time (for example, at intervals of one hour) using the already stored learning data. Alternatively, the weighting factor may be corrected when the traffic becomes less and the frequency with which the estimated car delay operation means 10D operates the estimated car delay is thus lessened.

Furthermore, correction of the weighting factor may be repeated a plurality of times (e.g., five hundred times on five hundred data) so that the weighting factor can be converged to a desired approximated value.

What is claimed is:

1. An elevator control apparatus for allocating cars to respond to hall calls based on estimated car delay and for controlling operation of the cars, comprising:

an input data conversion means for converting traffic data, including data indicating positions of the cars, data indicating direction of movement of the cars, and data indicating existence of car calls and hall calls into a form compatible with a neural network;

a neural network including an input layer for receiving data from said input data conversion means, an output layer for outputting a signal representative of an estimated delay of the cars, and an intermediate layer provided between the input and output layers, each of the input, output and intermediate layers having a plurality of nodes interconnected by weighting factors;

an output data conversion means for converting the estimated car delay output from the output layer of said neural network into control data;

learning data creation means for storing the input data and the estimated car delay for a predetermined hall at a predetermined time during operation of the elevator, for storing a car delay when the car stops at or passes the predetermined hall as an actual car delay, and for outputting the stored input data, the estimated car delay and the actual car delay as one learning data pair;

a correction means for correcting the weighting factors based on the learning data pairs;

allocation means for calculating evaluated values based on estimated car delay signals represented by control data output from said output data conversion means and for allocating a selected car having a minimum evaluated value to a hall call; and means for dispatching the allocated car to a floor corresponding to the allocated hall call.

2. An elevator control apparatus according to claim 1 wherein said input data conversion means has a standardization means for standardizing the traffic data into a value ranging from 0 to 1.

3. An elevator control apparatus according to claim 1 wherein said correction means includes a means for determining a desired car delay from the actual car delay and the input data, and a means for correcting the weighting factors such that errors between the desired car delay and the estimated car delay are reduced.

4. An elevator control apparatus according to claim 1 wherein said neural network determines the estimated car delay each time a hall call is registered.

5. An elevator control apparatus according to claim 1 wherein said input data conversion means converts traffic data including statistic features of the traffic and outputs the traffic data to said neural network.

6. An elevator control apparatus according to claim 5 wherein said input data conversion means converts the statistical number of passengers entering the car over a predetermined time and the statistical number of passengers exiting the car over a predetermined time and outputs the statistical numbers to said neural network.

7. An elevator control apparatus according to claim 1 wherein said learning data creation means creates the learning data at predetermined time intervals.

8. An elevator control apparatus according to claim 1 wherein said learning data creation means creates the learning data when a car is stopped.

9. An elevator control apparatus according to claim 1 wherein said learning data creation means creates repeatedly the learning data each time allocation of the hall call is made.

10. An elevator control apparatus according to claim 1 wherein said correction means corrects the weighting factors at predetermined time intervals.

11. An elevator control apparatus according to claim 1 wherein said correction means corrects the weighting factors when the learning data is created.

12. An elevator control apparatus according to claim 1 wherein said neural network uses a wrong forecasting probability as the estimated car delay.

13. An elevator control apparatus according to claim 1 wherein said neural network uses an estimated value of the sequence in which the car arrives as the estimated car delay.

14. An elevator control apparatus according to claim 3 wherein said means for correcting weighting factors corrects weighting factors on the basis of difference between actual delay of the cars and estimated delay of the cars.

15. An elevator control apparatus according to claim 8 wherein said learning data creation means creates learning data when a car is stopped at a predetermined floor.

16. An elevator control apparatus according to claim 8 wherein said learning data creation means creates learning data when a car is decelerated.

17. An elevator control apparatus according to claim 8 wherein said correction means corrects the weighting factors each time learning data is created.

18. An elevator control apparatus for estimating a degree of delay of time required for cars to reach a hall as estimated car delay and for controlling operation of the cars based on the car delay, said elevator control apparatus having a registration means for registering a hall call when a hall button provided at a hall is operated; an allocation means for selecting and allocating a car to respond to the hall call; and a car control means for control direction of movement of cars, run/stop operation of cars, and door open/close operation in order for the allocated car to respond to the hall call, said elevator control apparatus comprising:

an input data conversion means for converting traffic data, including data indicating positions of the cars, data indicating direction of movement for the cars, and data indicating existence of car calls and hall calls into a form compatible with a neural network;

an estimated car delay operation means including an input layer for receiving data from said input data conversion means, an output layer for outputting a signal representative of the estimated delay of the cars, and an intermediate layer provided between the input and output layers in which weighting factors are set, said estimated car delay operation means comprising a neural net;

an output data conversion means for converting the estimated car delay operation means into control data;

a learning data creating means for storing the estimated car delay for a predetermined hall and the converted traffic data at a predetermined time during the operation of the elevator, for storing a car delay when said car stops at or passes the predetermined hall as an actual car delay, and for outputting the stored converted traffic, the estimated car delay, and the actual car delay as one learning data pair; and a correction means for correcting the weighting factors set in the intermediate layer of said estimated car delay operation means using the learning data pairs output from said learning data creation means.

19. An elevator control apparatus according to claim 18 further comprising means for dispatching a car to a floor containing the hall call based upon the control data of said output data conversion means.

* * * * *

UNITED STATES PATENT AND TRADEMARK OFFICE

CERTIFICATE OF CORRECTION

PATENT NO. : 5,529,147

DATED : June 25, 1996

INVENTOR(S) : Tsuji

It is certified that error appears in the above-indentified patent and that said Letters Patent is hereby corrected as shown below: Title page, item: [56]

Other Publications: insert the following:

--"Computers That Learn": Aerospace America; June 1988.--;

--"Chips for the Nineties and Beyond"; BYTE; pp 342-346; Nov. 1990.--;

Related U.S. Application Data: change "714,015" to --714,025--.

Signed and Sealed this

Eighth Day of October, 1996

Bruce Lehman

*Attest:*

BRUCE LEHMAN

*Attesting Officer*

*Commissioner of Patents and Trademarks*